US006049691A

United States Patent [19]

Abe et al.

[11] Patent Number: 6,049,691

[45] **Date of Patent: *Apr. 11, 2000**

[54] IMAGE HEATING APPARATUS

[75] Inventors: Atsuyoshi Abe, Susono; Tohru Saito, Mishima; Hideo Nanataki, Tokyo; Tetsuya Sano, Numazu, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/867,337

[22] Filed: Jun. 2, 1997

[30] Foreign Application Priority Data

May 31, 1996 [JP] Japan ..... 8-160603

[51] Int. Cl.[7] ..... G03G 15/20

[52] U.S. Cl. ..... 399/330; 399/328; 219/619; 219/671

[58] Field of Search ..... 399/328, 330, 399/331; 219/216, 619, 670, 671, 469–471

[56] References Cited

U.S. PATENT DOCUMENTS

| | | | |
|---|---|---|---|
| 4,570,044 | 2/1986 | Kobayashi et al. | 219/619 |
| 5,153,654 | 10/1992 | Yuminamochi et al. . | |
| 5,177,549 | 1/1993 | Ohtsuka et al. . | |
| 5,196,895 | 3/1993 | Setoriyama et al. | 399/328 |
| 5,303,016 | 4/1994 | Oda et al. | 399/329 |
| 5,438,398 | 8/1995 | Tanigawa et al. . | |
| 5,526,103 | 6/1996 | Kato et al. | 399/328 |
| 5,568,240 | 10/1996 | Ohtsuka | 399/335 |
| 5,666,627 | 9/1997 | Yamaguchi | 399/330 |
| 5,713,069 | 1/1998 | Kato | 399/330 |
| 5,870,660 | 2/1999 | Ito et al. | 399/330 |
| 5,970,299 | 10/1999 | Sano et al. | 399/330 |

FOREIGN PATENT DOCUMENTS

| | | |
|---|---|---|
| 8-016007 | 1/1996 | Japan . |
| 8-030126 | 2/1996 | Japan . |
| 8-044227 | 2/1996 | Japan . |
| 9-026717 | 1/1997 | Japan . |

*Primary Examiner*—Matthew S. Smith
*Attorney, Agent, or Firm*—Fitzpatrick, Cella, Harper & Scinto

[57] ABSTRACT

An image heating apparatus has a heat generating element with an electroconductive portion; a magnetic flux generating unit for generating a magnetic flux, wherein the magnetic flux generated by the magnetic flux generating unit produces eddy current in the heat generating element to heat the heat generating element; a back-up member cooperating with the heat generating element to form a nip therebetween, wherein the nip feeds a recording material carrying an image; a pressing member for applying pressure to the nip; a holding member of metal for holding a pressure by the pressing member; and a shield member provided between the magnetic flux generating unit and the holding member, for shielding magnetic.

39 Claims, 8 Drawing Sheets

IMAGE HEATING APPARATUS

FIELD OF THE INVENTION AND RELATED ART

The present invention relates to an image heating apparatus employed in an image forming apparatus such as a copy machine or a printer. In particular, it relates to an apparatus which heats an image using the heat generated by electromagnetic induction.

For the sake of convenience, the related art will be described with reference to an image heating apparatus (fixing apparatus) which is employed in an image forming apparatus, such as a copy machine or a printer, that fixes a toner image onto recording medium (image bearing member) by heat.

In an image forming apparatus, an unfixed image (toner image) of a target image, which is formed by image forming means employing an image forming process, such as an electrophotographic process, an electrostatic recording process, a magnetic recording process, directly on a sheet of recording material (transfer sheet, electro-facsimile sheet, electrostatic recording sheet, OHP sheet, printing paper, format sheet), or is formed by the image forming means on a temporary image bearing member, and then is transferred therefrom onto the sheet of recording medium, is thermally fixed to the recording surface of the recording material by a fixing apparatus, becoming thereby a permanent image. As for such a fixing apparatus, a heat roller type fixing apparatus has been widely used. Recently, however, a film heating type fixing apparatus has been put to practical use, and a fixing apparatus employing an electromagnetic induction based heating system has been proposed.

For example, Japanese government journal Tokko No. 9,027/1993 discloses an electromagnetic induction heating type fixing apparatus, in which eddy current is induced in a fixing roller by magnetism to generate heat (Joule heat). This apparatus can use induction current to generate heat directly in a fixing roller, which makes this apparatus superior to a heat roller type fixing apparatus employing a halogen heater as a heat source, in terms of energy utilization efficiency.

Also, in Japanese government journal Tokkai No. 237, 308/1996, an apparatus for heating a toner image is described, in which heat is generated in a sheet of film by electromagnetic induction, and a toner image is heated by putting a sheet of recording material bearing the toner image through a nip formed by the film and a pressure roller, wherein pressure is applied to a pressing member by a spring to generate pressure in the nip. Since this pressing member requires a certain amount of rigidity, it should be made of metallic material. However, some metallic materials absorb magnetic force, and thereby reduce the amount of heat generated in the film; the employment of such metallic material reduces heat generating efficiency.

The problem described above is taken into consideration by the invention disclosed in Japanese government journal Tokkai No. 137,308/1996, in which a pressing member is formed of nonmagnetic material. However, limiting the choice of the material for a pressing member to nonmagnetic material created a problem in terms of the rigidity of the pressing member.

Further, in a structure in which a pressure generating spring is disposed at each end of the pressure bearing member, the center portion of the pressure bearing member receives less pressure than each end, that is, it is difficult to evenly apply pressure with such placement of the springs.

SUMMARY OF THE INVENTION

The primary object of the present invention is to provide an image heating apparatus with such a structure that improves efficiency in electromagnetic induction based heat generation without limiting the choice of material for a pressure bearing member.

Another object of the present invention is to provide an image heating apparatus in which a magnetism shielding member is disposed between a pressure bearing member and magnetic flux generating means.

Another object of the present invention is to provide an image heating apparatus in which pressure is uniformly generated across the length of a nip formed at the interface between a heating member and a back-up member.

Another object of the present invention is to provide an image heating apparatus comprising an intermediary member which is disposed between a pressure bearing member and a nip, wherein the surface of the intermediary member gently rises toward the longitudinal center thereof, forming a crown-like configuration.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Hereinafter, the embodiments of the present invention will be described with reference to the drawings.

Figure 1:
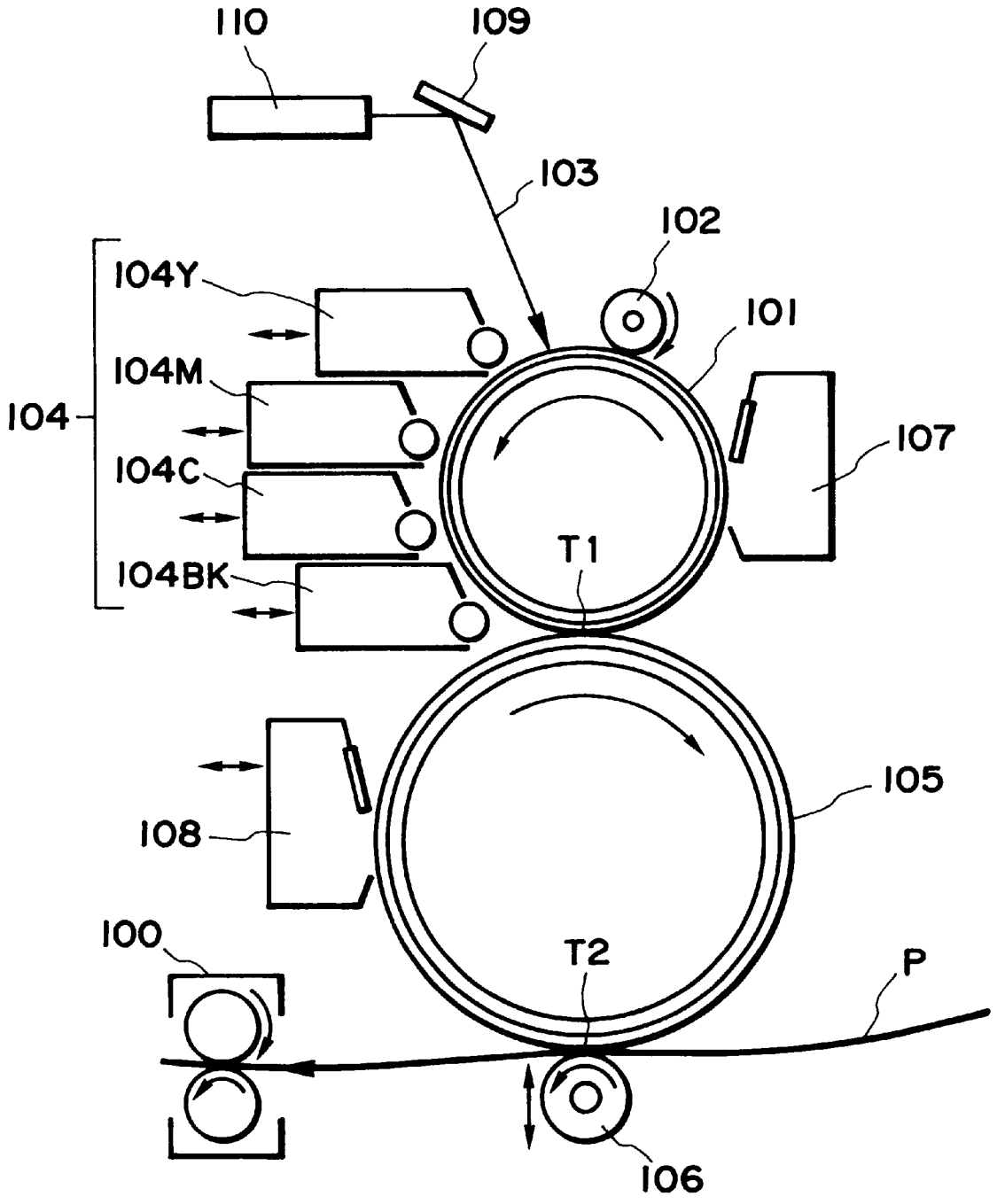
FIG. 1 is a schematic section of an image forming apparatus employing the image heating apparatus in an embodiment of the present invention.

FIG. 1 is a schematic section of an image forming apparatus in accordance with the present invention, depicting the general structure thereof. The image forming apparatus in this embodiment is an electrophotographic color printer.

A reference numeral 101 designates an electrophotographic photosensitive drum (image bearing member)

formed of organic photosensitive material or amorphous silicon, and is rotatively driven in the counterclockwise direction indicated by an arrow mark at a predetermined process speed (peripheral velocity).

As the photosensitive drum 101 is rotated, it is uniformly charged to a predetermined polarity and a predetermined potential level by a charging apparatus 102 such as a charging roller.

Then, the charged surface of the photosensitive drum 101 is exposed to a scanning laser beam 103 which is projected from a laser based optical box (laser scanner) 110, carrying the information for forming an image of a target image; the laser based optical box 110 receives sequential electrical image element signals in digital form from an unillustrated imaging signal generating apparatus such as an image reading apparatus, and projects the scanning laser beam 103 modulated (turned on/off) in response to the received digital image element signals to expose the surface of the rotating photosensitive drum. Through this scanning exposure, an electrostatic latent image correspondent to the image data obtained by scanning the target image is formed on the surface of the photosensitive drum 101. A reference numeral 109 designates a mirror which deflects the laser bean outputted from the laser based optical box toward a spot on the photosensitive drum 101, that is, a spot to be exposed.

When forming a full-color image, a target full-color image is separated into, for example, four images of different color components, and the aforementioned electrostatic latent image is formed for each of the four colors. More specifically, first, an electrostatic latent image is formed for the first of the four colors, for example, the yellow color component through the aforementioned scanning exposure, and is developed as a yellow toner image by a yellow color developing device 104Y, one of the four color developing devices in a developing apparatus 104. The thus formed yellow toner image is transferred onto the surface of an intermediary transfer drum 105 in a primary transfer station T1 which is the contact area between the photosensitive drum 101 and the intermediary transfer drum 105 (or the region in which the peripheral surfaces of the two drums 101 and 105 are placed extremely close to each other). After the toner image is transferred onto the intermediary transfer drum 105, the surface of the rotating photosensitive drum 101 is cleaned by a cleaner 107 to remove residue such as residual toner adhering to the surface thereof.

The above described cycle comprising the charging, scanning exposure, development, primary transfer, and cleaning processes is sequentially carried out for the rest of the four color components to form an image for the second color component (for example, a magenta component image developed by a magenta color developing device 104M), the third color component (for example, a cyan component image developed by a cyan color developing device 104C), and the fourth color component (for example, a black color component image developed by a black color developing device 104Bk). As a result, four color toner images, that is, a yellow toner image, a magenta toner image, a cyan toner image, and a black toner image, are sequentially superposed on the surface of the intermediary transfer drum 105, synthesizing a full-color image of the target image.

In this embodiment, toner which contains ingredients with low meltage is employed.

The intermediary transfer drum 105 comprises a metallic drum, an elastic layer laminated on the metallic drum, and a surface layer laminated on the elastic layer. The elastic layer and the surface layer have a medium resistance and a high resistance, respectively. The intermediary transfer drum 105 is rotatively driven in the clockwise direction indicated by an arrow mark at substantially the same peripheral velocity as the photosensitive drum 101, with the surfaces of the two drums in contact with, or extremely close to, each other, and bias voltage is applied to the metallic drum of the intermediary transfer drum 105 to transfer the toner images carried on the surface of the photosensitive drum 101, onto the surface of the intermediary transfer drum 105 using the potential difference between the two drums.

The color toner image synthetically formed on the surface of the rotating intermediary transfer drum 105 is transferred, sequentially from one end to the other, onto the surface of a sheet of recording material P fed into a second transfer station T2, that is, a contact nip between the rotating intermediary transfer drum 105 and a transfer roller 106, from an unillustrated sheet feeding section, with a predetermined timing. The transfer roller 106 gives the recording material P electrical charge from the back side of the recording material P to transfer, all at once, the four color toner images synthetically forming the full-color image on the intermediary transfer drum 105, onto the recording material P, sequentially from one end to the other.

After passing through the second transfer station T2, the recording material P is separated from the surface of the intermediary transfer drum 105, and is introduced into an image heating apparatus (fixing apparatus) 100, in which the unfixed toner image on the recording material P is fixed to the recording material P by heat, becoming a permanent image. Thereafter, the recording material P is discharged as a color print into an unillustrated external delivery tray. The fixing apparatus 100 will be described later in detail.

After the color toner image is transferred onto the recording material P, the rotating intermediary transfer drum 105 is cleaned by a cleaner 108 to remove residue such as residual toner or paper dust. This cleaner 108, which normally is disposed away from the surface of the intermediary transfer drum 105, is placed in contact with the intermediary transfer drum 105 during the second transfer process in which the toner image is transferred from the intermediary transfer drum 105 onto the recording material P.

Also, the transfer roll 106, which normally is also kept away from the surface of the intermediary transfer drum 105, is pressed upon the intermediary transfer drum 105, with the recording material P being interposed between the two drums, during the second transfer process in which the color toner image is transferred from the intermediary transfer drum 105 onto the recording material P.

The image forming apparatus in this embodiment can carry out a printing mode for creating a monochromatic image such as a black-and-white image, as well as a double-sided printing mode and a multi-layer printing mode.

In the case of the double-side printing mode, after coming out of the fixing apparatus 100, with an image of the first (front) surface, the recording material P is sent through an unillustrated sheet recirculating conveyer system, being turned over therein, and then, is introduced again into the second transfer station T2, receiving another toner image on the second (back) surface. Thereafter, it is re-introduced into the fixing apparatus, having the second toner image fixed to the second surface, and is outputted as a double-side print.

In the case of the multi-layer printing mode, the printing material P having come out of the fixing apparatus 100, with an image on the first surface, is sent through an unillustrated sheet recirculating conveyer system, without being turned over, and then, is introduced again into the second transfer station T2, in which another toner image is transferred onto the transfer material P, on the surface which has already received one toner image. Thereafter, the printing material P is re-introduced into the fixing apparatus 100, having the second toner image fixed, and is outputted as a multi-layer print.

Figure 2:
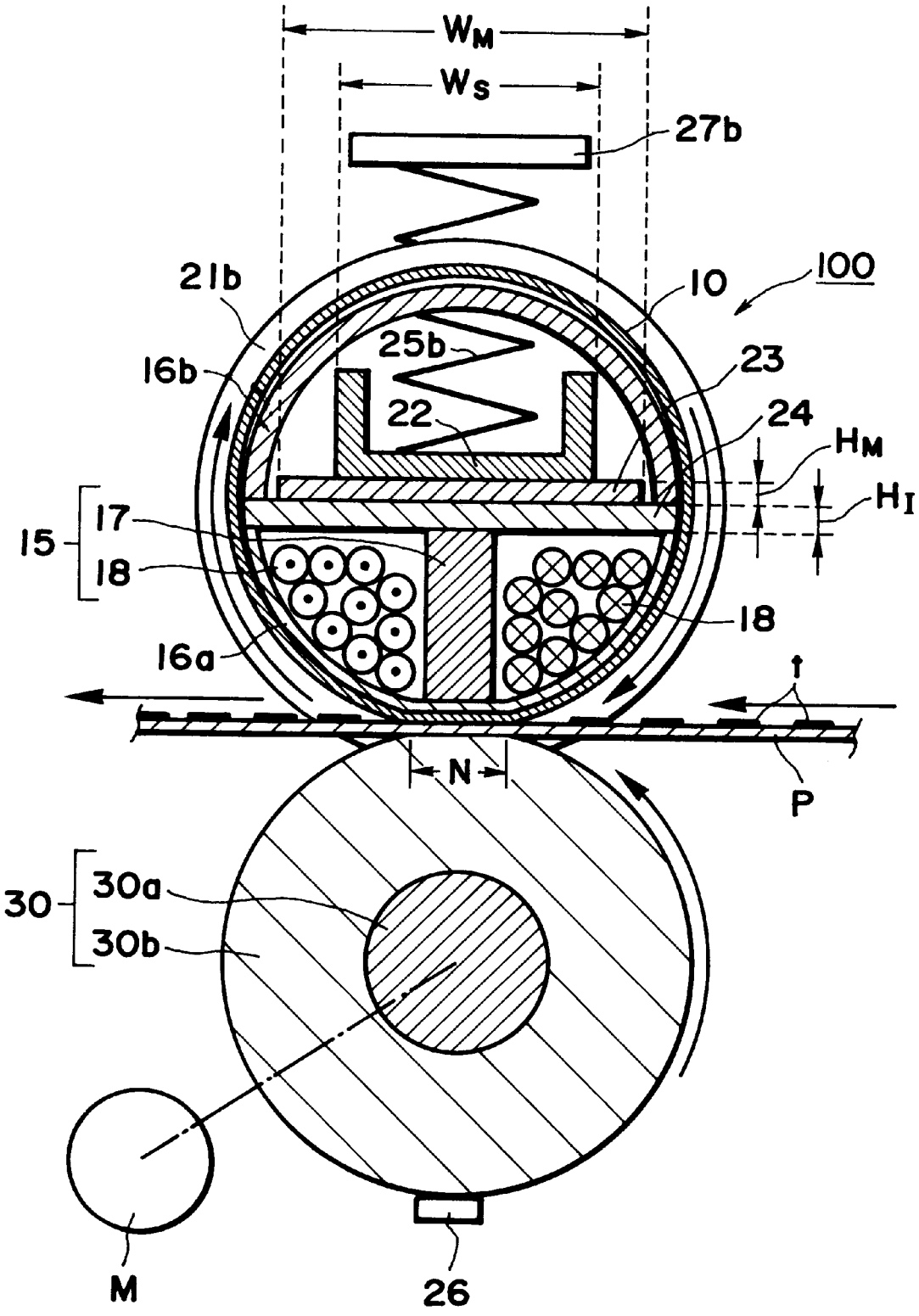
FIG. 2 is a cross-section of an image heating apparatus.
Figure 3:
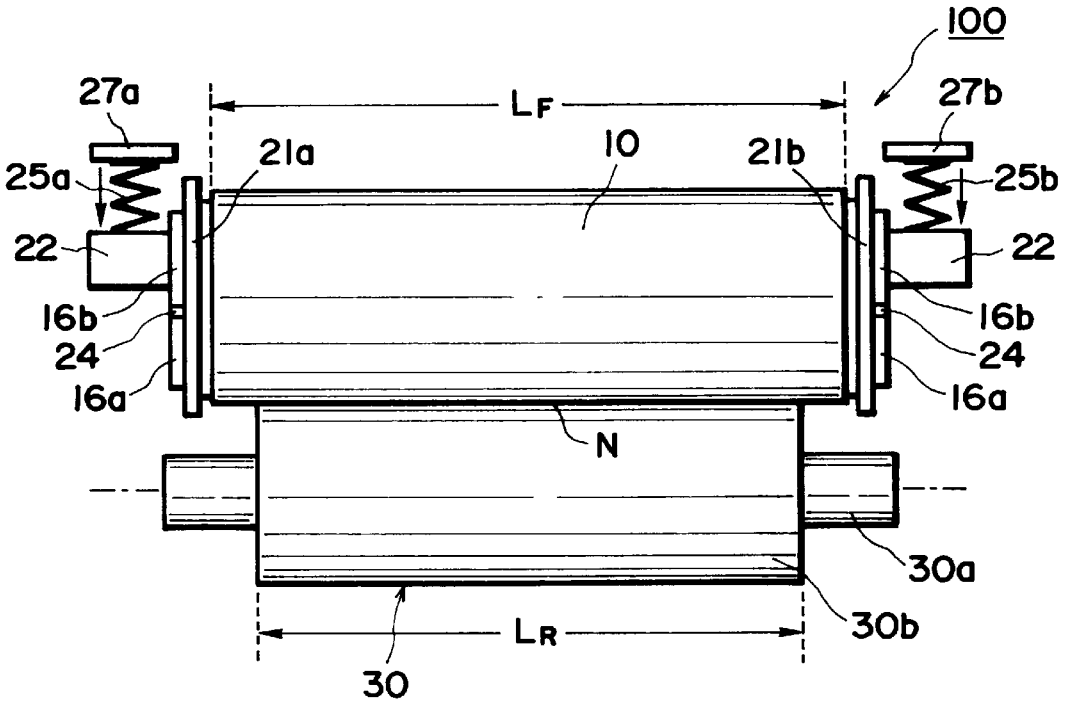
FIG. 3 is a front view of an image heating apparatus.
Figure 4:
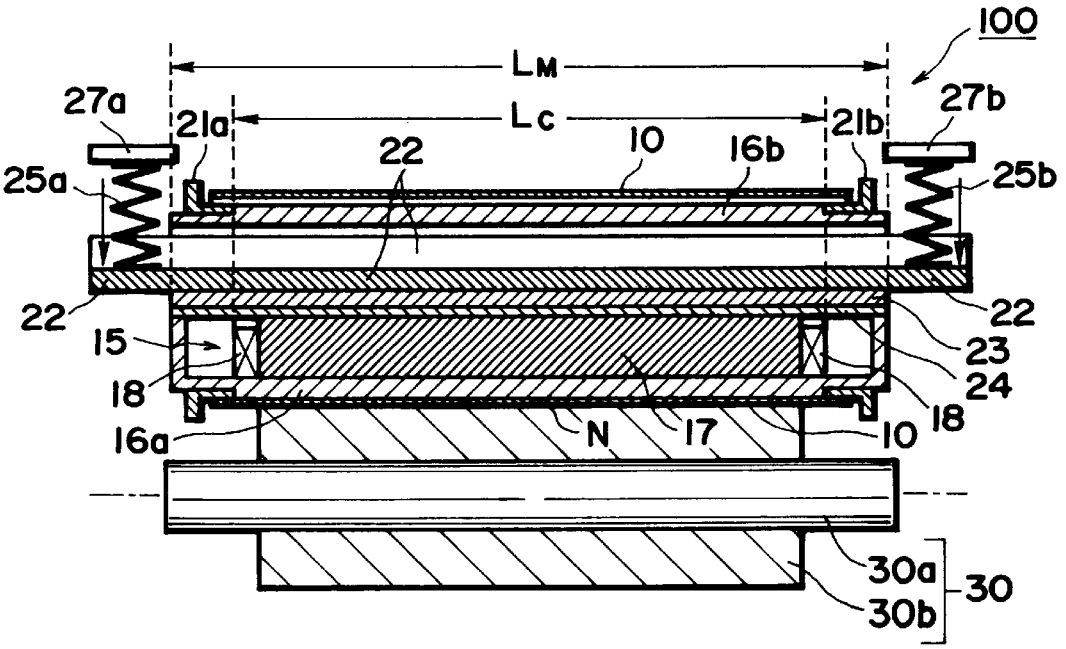
FIG. 4 is a longitudinal section of an image heating apparatus.
Figure 5:
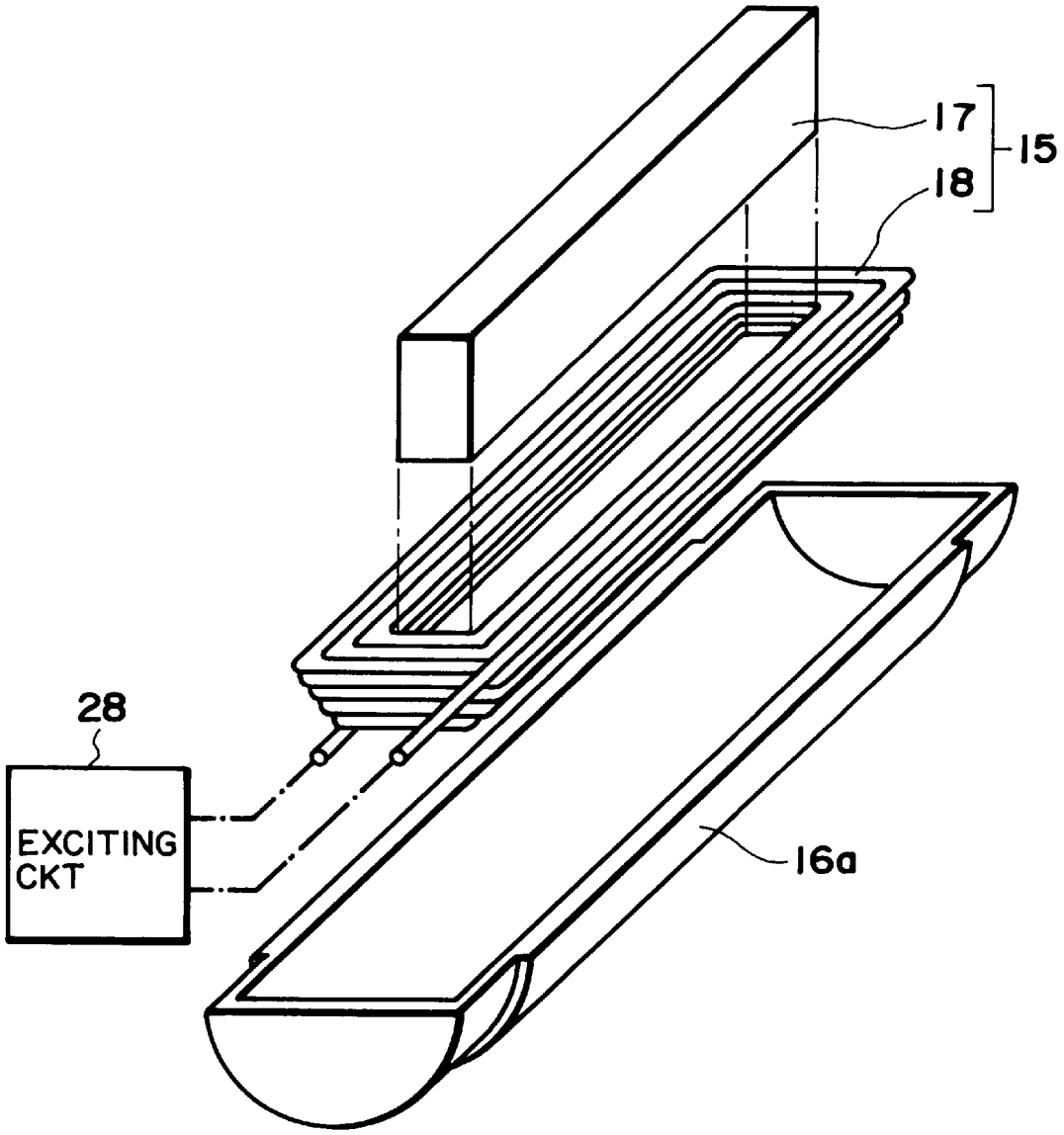
FIG. 5 is an exploded perspective view of an essential portion of an image heating member, depicting the bottom side guide, coil, and core, in this order from the bottom.

FIG. 2 is a cross-section of the essential portion of the fixing apparatus 100 in the first embodiment of the present invention; FIG. 3, a schematic front view of the same; FIG. 4, a longitudinal schematic section of the same; and FIG. 5 is an exploded perspective view of the same, depicting the bottom side film guide, exciter coil, and core, in this order from the bottom.

Referential numerals 16*a* and 16*b* designate top and bottom film guides in the form of a trough, which extend in the direction perpendicular to the direction in which the recording material P is conveyed, and their cross-sections are substantially semicircular. The bottom film guide 16*a* is disposed with its open side facing upward, and the top film guide 16*b*, with its opening facing downward, is placed on top of the bottom film guide 16*a*, so that a substantially cylindrical member is formed by the top and bottom film guides 16*a* and 16*b*.

A referential numeral 15 designates a magnetic field (magnetic flux) generating means, which comprises an exciter coil 18 and an core (exciter iron core) 17, both of which extending the longitudinal direction of the apparatus. They are supported within the internal space of the bottom film guide 16*a*.

A referential numeral 24 designates an electrically insulative oblong plate, which is disposed so as to cover the upward facing opening of the bottom film guide 16*a* containing the exciter coil 18 and the core 17 which together constitute the magnetic field generating means.

A referential numeral 22 designates an oblong metallic stay as a pressure bearing member. The stay 22 is given a form that imparts rigidity to the stay 22, and is disposed on an oblong magnetism shielding plate 23 which is disposed on the insulative plate 24.

Since the downwardly opening top film guide 16*b* is placed on the upwardly opening bottom film guide 16*b* containing the exciter coil 18 and core 17 as the magnetic field generating means, insulative plate 24, magnetism shielding plate 23, and stay 22, a substantially cylindrical member is formed. The longitudinal ends of the insulative plate 24 are pinched between the longitudinal ends of the top and bottom film guide 16*a* and 16*b*.

A referential numeral 10 designates a rotary heat generating member, which is a cylindrical fixing film comprising an electromagnetic induction based heat generating layer (conductive layer, magnetic layer, resistive layer). The film is loosely fitted around the top and bottom film guide 16*a* and 16*b* joined together to form a substantially cylindrical member.

Referential numerals 21*a* and 21*b* designate the left and right circular flanges, which are fitted, like a barrel hoop, around the left and right ends, respectively, of the cylindrical member formed by joining the film guides 16*a* and 16*b*, to hold the top and bottom film guide 16*a* and 16*b* together, and confine the fixing film 10.

An assembly comprising the bottom film guide 16*a*, exciter coil and core 17 which constitute the magnetic field generating means 15, insulative plate 24, magnetism shielding plate 23, stay 22, top film guide 16*b*, fixing film 10, and left and right circular flanges 21*a* and 21*b*, constitutes a first assembly portion, which will be called "heating assembly" for ease of reference.

A referential numeral 30 designates a pressing member, that is, a back-up member, as a second assembly portion. In this embodiment the pressing member 30 is an elastic pressure roller comprising a metallic core 30*a*, and a cylindrical heat resistant elastic layer 30*b* of silicon rubber, fluorinated rubber, fluorinated resin, or the like, coated on the peripheral surface of the metallic core 30*a* in a manner to form a roller which is coaxial with the metallic core 30*a*. In the case of the fixing apparatus in this embodiment, both longitudinal ends of the metallic core 30*a* of the pressure roller 30 are rotatively supported between the unillustrated front and rear chassis walls of the apparatus, with the front and rear bearings, respectively.

The aforementioned heating assembly is placed on the pressure roller 30, with the bottom film guide side 16*a* in contact with the pressure roller 30, and compression springs 25*a* and 25*b* constituting pressure generating members are compressed into the spaces between the longitudinal ends of the stay 22 and the corresponding spring seats 27*a* and 27*b*, so that the stay 22 is pressured downward. As a result, the bottom film guide 16*a* and the core 17 are pressed downward through the magnetism shielding plate 23 and the insulative plate 24, causing the bottomwardly facing portion of the peripheral surface of the bottom film guide 16*a* and the upwardly facing portion of the peripheral surface of the pressure roller 30 to press each other, forming a fixing nip N, with the fixing film 10 pinched between the two surfaces.

The bottom surface of the core 17 squarely faces the fixing nip N through the bottom portion of the bottom film guide 16*a*, and the top surface of the core 17 is in contact with the bottom surface of the insulative plate 24.

The pressure roller 30 is rotatively driven in the counterclockwise direction indicated by an arrow mark by a driving means M. As the pressure roller 30 is rotatively driven, the rotational force is transmitted to the fixing film 10 by the friction between the pressure roller 30 and the outwardly facing surface of the fixing film 10, causing the fixing film 10 to be rotated around the cylindrical member constituted of the top and bottom film guides 16*b* and 16*a*, in the clockwise direction indicated by an arrow mark, with the inwardly facing surface the fixing film 10 sliding on the downwardly facing surface of the bottom film guide 16*a*, at substantially the same speed as the peripheral velocity of the pressure roller 30, in the fixing nip N (pressure roller driving system).

In order to reduce the friction which occurs as the downwardly facing surface of the bottom guide film guide 16*a* and the inwardly facing surface of the fixing film 10 rub against each other in the fixing nip N, lubricant such as heat resistant grease may be applied between the downwardly facing surface of the bottom film guide 16*a* and the inwardly facing surface of the fixing film 10, or the downwardly facing surface of the bottom film guide 16*a* may be coated with lubricational material.

To the exciter coil 18, an exciter circuit 28 (FIG. 5) is connected. The exciter circuit 28 is such a circuit that can generate high frequency waves ranging from 20 kHz to 500 kHz with the use of a switching electrical power source.

The exciter coil 18 generates an alternating magnetic flux as it receives alternating current (high frequency current) from the exciter circuit 28. The alternating magnetic flux is guided by the magnetic core 17 so that it concentrates to the fixing nip N and the adjacencies thereof, generating eddy current in the electromagnetic induction heat generating layer of the fixing film 10, mainly in the fixing nip N and the adjacencies thereof. The eddy current generates Joule heat in the electromagnetic induction heat generating layer due to the specific resistance of the electromagnetic induction heat generating layer; in other words, the fixing film 10 generates heat due to electromagnetic induction. Since the alternating magnetic flux is concentrated to the fixing nip N and the adjacencies thereof, the heat is concentratedly generated in the portion of the fixing film 10, that is, the portion in the fixing nip N and the adjacencies thereof; in other words, the fixing nip portion N is heated with high efficiency.

The temperature of the fixing nip N is maintained at a predetermined level by a temperature controlling system which comprises temperature detecting means and controls the electric current supplied to the exciter coil 18.

A referential numeral 26 (FIG. 2) designates a temperature sensor, such as a thermistor, which detects the temperature of the pressure roller 30. In this embodiment, the temperature of the pressure roller 30 detected by the temperature sensor 26 is also used in addition to other information to control the temperature of the fixing nip N.

As the pressure roller 30 is rotatively driven, the fixing film 10 is rotated around the cylindrical member constituted of the top and bottom film guides 16*b* and 16*a*. Meanwhile, electrical power is supplied to the exciter coil 18 from the exciter circuit 28, causing the fixing film 10 to generate heat by electromagnetic induction to increase the temperature of the fixing nip N to a predetermined level. Then, with the temperature of the fixing nip N maintained at the predetermined level, the recording material P carrying an unfixed toner image t is conveyed from the image forming means to the mixing nip N, in which it is introduced between the fixing film 10 an the pressure roller 30, with the image bearing surface facing upward, that is, facing the fixing film 10, and is passed, together with the fixing film N, through the fixing nip N, with the image bearing surface being pressed upon the outwardly facing surface of the fixing film 10. While the recording material P is passed, being pinched therein, through the fixing nip N, together with the fixing film 10, it is heated with the heat generated in the fixing film 10 by electromagnetic induction, whereby the unfixed image t on the recording material P is thermally fixed. After coming out of the fixing nip N, the recording material P is separated from the outwardly facing surface of the rotating fixing film 10, and is carried to be discharged from the apparatus. The thermally fixed toner image on the recording material P cools down to become a permanent fixed image after the recording material P is passed through the fixing nip N.

The length $L_F$ (FIG. 3) of the fixing film 10, and the length $L_R$ of the pressure roller 30, are set to satisfy an inequality: $L_F > L_R$, so that the film edge is prevented from damaging the pressure roller.

The shifting of the fixing film 10 in the longitudinal direction of the film guide, which occurs as the fixing film 10 is rotated, is regulated by the left and right flanges 21*a* and 21*b*. These flanges 21*a* and 21*b* may be of a rotary type that follows the rotation of the fixing film 10.

In this embodiment, since such toner that contains ingredients with low meltage is employed as the toner t, the fixing apparatus is not equipped with an oil coating mechanism for preventing toner offset, but if usage of toner which does not contain ingredients with low meltage is intended, the apparatus may be equipped with an oil coating mechanism. Also, a cooling section may be provided after the fixing nip N to separate the recording material by cooling. Further, oil coating or cooling may be done even when toner containing ingredients with low meltage is employed.

The exciter coil 18 of the magnetic field generating means 15 is formed of insulated electrical wire, being wound a predetermined number of times in a predetermined pattern. The core 17 is a member with high permeability. As for the material for the core 17, such material as ferrite or Permalloy that is employed as the material for a transformer core is desirable, preferably, ferrite whose loss is small even when frequency is no less than 100 kHz.

In this embodiment, the exciter coil 18 is wound in the shape of a boat so that it substantially corresponds to the shape of the internal space of the bottom film guide 16*a*, and the core 17 is fitted through the center of the wound exciter coil 18.

The bottom and top film guides 16*a* and 16*b* serve to hold the cylindrical fixing film 10, and also stabilize the fixing film 10 as the fixing film 10 is rotated. The bottom film guide 16*a* supplies the fixing nip N with pressure, and supports the exciter coil 18 and core 17 of the magnetic field generating means 15, in addition to the aforementioned function. It is an insulative member that does not interfere with magnetic flux penetration. As for the material therefor, such heat resistant material that can withstand a heavy load is desirable; for example, phenol resin, fluorocarbon resin, polyimide resin, polyamide resin, polyamideimide resin, PEEK resin, PES resin, PPS resin, PFA resin, PTFE resin, FEP resin, LCP resin, or the like are recommendable.

The top film guide 16*b* may be formed of the same material as the bottom film guide 16*a*. Further, the top film guide 16*b* may be eliminated.

The stay 22 as the pressure bearing member is desirably such a member that is made of highly bend resistant metallic material such as iron, and has a highly bend resistant structure. However, the materials which satisfy the above description are magnetic materials which absorb the magnetic flux generated by the exciter coil 18, and therefore, reduce the amount of the magnetic flux which reaches the heat generating layer of the fixing film 10, deteriorating the heat generating efficiency of the fixing apparatus.

Therefore, in order to minimize the magnetic flux absorption by the stay 22, and to efficiently supply the heat generating layer of the fixing film 10 with magnetic flux, the magnetism shielding plate 23 is provided.

The magnetism shielding plate 23 is desirably formed of nonmagnetic material with good electrical conductivity, for example, Al, Cu, Ag, Au, or alloy containing at least one among Al, Cu, Ag, and Au. As for the material with good electrical conductivity, material whose volumetric resistivity ρ satisfies a mathematical formula: $\rho \leqq 3\times10^{-8}\ \Omega m$, is desirable. This is because nonmagnetic material with good electrical conductivity is effective to repel magnetic flux.

Referring to FIG. 2, the relationship between the width $W_S$ of the stay 22 and the width $W_M$ of the magnetism shielding plate 23 is set to satisfy the following mathematical formula:

$$W_M \geqq W_S$$

This is because when $W_M < W_S$, the magnetic flux reaches the stay 22 by circumventing the magnetism shielding plate 23, and the energy is absorbed by the stay 22.

It is desirable that the thickness $H_M$ of the magnetism shielding plate 23 satisfies the following mathematical formula:

$$H_M \geqq 0.5\ [mm]$$

This is because when $H_M \leqq 0.5$ [mm], a portion of the magnetic flux generated by the exciter coil 18 penetrates the magnetism shielding plate 23, reaching the stay 22 which absorbs the energy.

The distance $H_1$ between the magnetism shielding plate 23 and the exciter coil 18 should satisfy a mathematical formula: $H_1 \geqq 1$ [mm]. If $H_1$ is no more than 1 mm, which is too small, a portion of the magnetic flux from the exciter coil 18 is absorbed by the magnetism shielding plate 23; the energy is lost. As long as the magnetism shielding plate 23 is displaced no less than 1 mm away from the exciter coil 18, the energy loss caused by the magnetism shielding plate 23 is negligible.

With the implementation of the above described structure, the energy loss traceable to the stay 22 and the magnetism shielding plate 23 can be minimized to efficiently supply the heat generating layer, the principal receiver, of the fixing film 10 with a satisfactory amount of the magnetic flux.

Referring to FIG. 4, the relationship between the length $L_M$ of the magnetism shielding plate 23 and the length $L_C$ of the exciter coil 18 is set so as to satisfy the following inequality:

$$L_M > L_C$$

This is done to prevent the magnetic flux generated by the exciter coil 18 from reaching the stay 22 by circumventing the magnetism shielding plate 23.

In this embodiment, the magnetism shielding plate 23 is shaped like a piece of ordinary flat board, but it may be in the form of a piece of channel iron extending in a manner to follow the outwardly facing surface of the stay 22, or a piece of pipe such as square pipe extending in a manner to surround the stay 22, or in the like form.

The insulative plate 24 electrically insulates between the exciter coil 18 and the magnetism shielding plate 23, and at the same time, serves as a spacer which secures the distance $H_1$ between the core 17 an the magnetism shielding plate 23, as well as a certain distance between the exciter coil 18 and the magnetism shielding plate 23.

As for the material for the insulative plate 24, heat resistant insulative material is desirable; for example, heat resistant resin such as fluorocarbon resin, polyimide resin, polyamide resin, polyamideimide resin, PEEK resin, PES resin, PPS resin, PFA resin, PTFE resin, FEP resin, LCP resin, or the like is recommendable.

Since alternating current with high voltage flows through the exciter coil 18, the insulative plate 24 is designed for a certain amount of insulative distance to be secured between the exciter coil 18 and the magnetism shielding plate 23. It does not need to be in the form of a piece of ordinary flat board as long as it is capable of providing an effective insulative distance.

Figure 6:
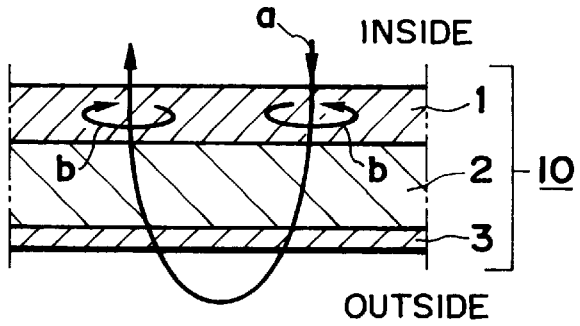
FIG. 6 is a section of a fixing film in accordance with the present invention, depicting the laminar structure thereof.

FIG. 6 is a schematic section of the fixing film 10 in this embodiment, depicting the laminar structure thereof. The fixing film 10 in this embodiment has a compound three layer structure, comprising a heat generating layer 1 composed of metallic film or the like, which constitutes the base layer of the fixing film which generates heat by electromagnetic induction, an elastic layer 2 laminated on the heat generating layer 1, and a "nonstick" layer. The heat generating layer 1 and the nonstick layer 3 constitute the inwardly facing layer and the outwardly facing layer, respectively, of the cylindrical fixing film 10. As described above, as alternating magnetic flux a acts on the heat generating layer 1, eddy current b is generated in the heat generating layer 1, and as a result, heat is generated in the heat generating layer 1. The thus generated heat heats the fixing nip N through the elastic layer 2 and the nonstick layer 3, and consequently, the recording material, as an object to be heated, is heated while it is passed through the fixing nip N so that the toner image thereon is thermally fixed to the recording material.

The heat generating layer 1 may be composed of non-magnetic metal, but highly magnetic metallic material such as nickel, iron, magnetic stainless steel, cobalt-nickel alloy, or the like, which is superior in magnetic flux absorbency is more desirable.

It is desirable that the thickness of the heat generating layer 1 is greater than a value σ (m) obtainable by the following equation, and at the same time, no more than 200 μm.

$$\sigma = 503 \times (\rho / f\mu)^{1/2}$$

(f: frequency [Hz] of exciter circuit; μ: permeability; ρ: specific resistance [Ω·m])

Figure 8:
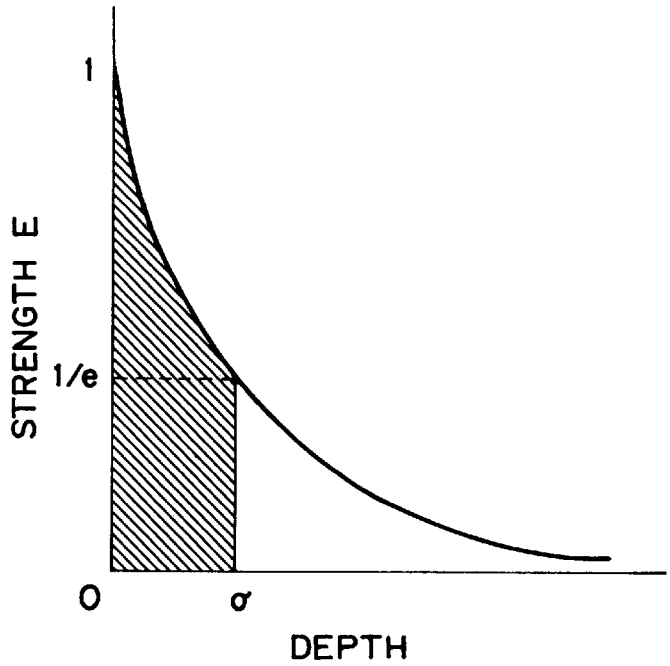
FIG. 8 is a graph showing the relationship between the strength of electromagnetic wave, and the depth that electromagnetic wave reaches into the heat generating layer.

This formula shows the depth which electromagnetic wave employed in electromagnetic induction reaches. Below the depth expressed by this formula, the strength of the electromagnetic wave is no more than 1/e. Conversely stated, most of the energy is absorbed before the wave reaches this depth (FIG. 8).

The thickness of the heat generating layer 1 is desirably in a range of 1–100 μm. When the thickness of the heat generating layer 1 is no more than 1 μm, most of the electromagnetic energy cannot be absorbed; efficiency is poor. When the thickness of the heat generating layer 1 is no less than 100 μm, the heat generating layer 1 becomes too rigid, or becomes inferior in flexibility; it is impractical to use film with such characteristics as a rotary member. Therefore, the thickness of the heat generating layer 1 is desirably in the range of 1–100 μm.

As for the material for the elastic layer 2, material such as silicone rubber, fluorinated rubber, fluoro-silicone rubber, or the like, which is superior in heat resistance and thermal conductivity, is desirable.

The thickness of the elastic layer 2 is desirably in a range of 10–500 μm; the thickness of the elastic layer 2 is necessary to be in this range to guarantee the quality of a fixed image.

When printing a color image, in particular, a photographic color image, certain areas on the recording material P are occupied with solid colors. In this situation, the heating surface (nonstick surface) must be able to conform to the textural uneven created on the surface of the recording material by the recording material itself and the toner layer, or the recording material is unevenly heated, causing the glossiness of the image to be different between the areas which receive more heat and the areas which receive less heat; the areas which receive more heat become glossier than the areas which receive less heat. As for the thickness of the elastic layer 2, when it is no more than 10 μm, it fails to conform to the textural irregularities on the toner layer surface, creating an irregular image in terms of glossiness, and when it is no less than 1000 μm, its thermal resistance increases, which slows down the start-up speed of the apparatus. In consideration of the above concern, the thickness of the elastic layer 2 is desirably in a range of 50–500 μm.

When the hardness of the elastic layer 2 is excessively high, the elastic layer 2 fails to conform to the textural irregularities of the recording material surface itself or the toner layer surface, and as a result, the image becomes nonuniform in terms of glossiness. Therefore, the hardness of the elastic layer 2 is desirably no more than 60° in JIS-A scale, preferably, no more than 40°.

It is desirable that the thermal conductivity λ of the elastic layer 2 satisfies the following formula:

$$6\times10^{-4}\leqq\lambda\leqq2\times10^{-3}\ [\text{cal/cm·sec·deg}]$$

When the thermal conductivity λ is no more than $6\times10^{-4}$ [cal/cm·sec·deg], the thermal resistance increases, which reduces the speed at which the temperature of the surface layer (nonstick layer 3) of the fixing film 10 rises.

When the thermal conductivity λ is no less than $2\times10^{-3}$ [cal/cm·sec·deg], the hardness becomes excessive, or the permanent distortion traceable to compression becomes worse.

Therefore, the thermal conductivity of the elastic layer 2 is desirably in a range of $6\times10^{-4}$–$2\times10^{-3}$ [cal/cm·sec·deg], preferably, in a range of $8\times10^{-4}$–$1.5\times10^{-3}$ [cal/cm·sec·deg].

The material for the nonstick layer 3 can be selected from among those superior in mold releasing properties and heat resistance, for example, fluorocarbon resin, silicon resin, fluoro-silicone rubber, fluorinate rubber, silicon rubber, PFA, PTFE, FEP, or the like.

The thickness of the nonstick layer 3 is desirably in a range of 1–100 μm. Thickness no more than 1 μm makes the nonstick layer 3 nonuniform, which makes some areas of the nonstick layer 3 inferior in mold releasing properties or durability. Thickness no less than 100 μm reduces the thermal conductivity, and also increases the hardness of the nonstick layer 3, canceling the effect of the elastic layer 2, in particular, in case the nonstick layer 3 is composed of resin material.

Figure 7:
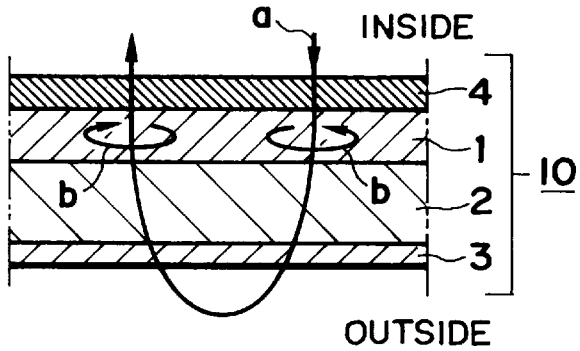
FIG. 7 is a section of another fixing film in accordance with the present invention, depicting the laminar structure thereof.

Referring to FIG. 7, the laminar structure of the fixing film 10 may comprise a thermally insulative layer 4, which is disposed on the free surface side (side opposite to the elastic layer 2) of the heat generating layer 1.

As for the material for the thermally insulative layer 4, heat resistant resin, such as fluorocarbon resin, polyimide resins, polyamide resin, polyamideimide resin, PEEK resin, PES resin, PPS resin, PFA resin, PTFE resin, FEP resin, or the like is recommendable.

The thickness of the thermally insulative layer 4 is desirably in a range of 10–1000 μm. If the thickness of the thermally insulative layer 4 is no more than 10 μm, there will not be sufficient insulative effect, and also, the durability of the insulative layer 4 will be reduced. On the other hand, if the thickness of the thermally insulative layer 4 exceeds 1000 μm, the distances from the heat generating layer 1 to the core 17 and exciter coil 18 increases, which makes it difficult for the magnetic flux to be fully absorbed.

The thermally insulative layer 4 blocks the heat which generates in the heat generating layer 1 from conducting inward of the fixing film 10. Therefore, when the laminar structure comprises the thermally insulative layer 4, efficiency increases in supplying the heat from the heat generating member 1 to the recording material P compared to when the laminar structure does not comprise the thermally insulative layer 4; the provision of the thermally insulative layer 4 reduces electrical power consumption.

Next, an embodiment of the present invention in which pressure can be evenly applied across the entire length of the fixing nip N will be described.

As described above, the compression springs 25*a* and 25*b* are disposed at the corresponding ends of the stay 22 to press down the stay 22 so that the bottom film guide 16*a* and the core 17 are pressed downward, causing the downwardly facing surface of the bottom film guide 16*a* and the upwardly facing portion of the pressure roller 30 to be pressed against each other, forming the fixing nip N, with the fixing film 10 interposed between the two surfaces. When downward pressure is applied to the stay 22, at each of the longitudinal ends, both longitudinal ends of the magnetism shielding plate 23 each act as a fulcrum, being liable to cause the distribution of the applied pressure to be such that pressure is less across the longitudinal central portion of the fixing nip N than the longitudinal ends.

Figure 9:
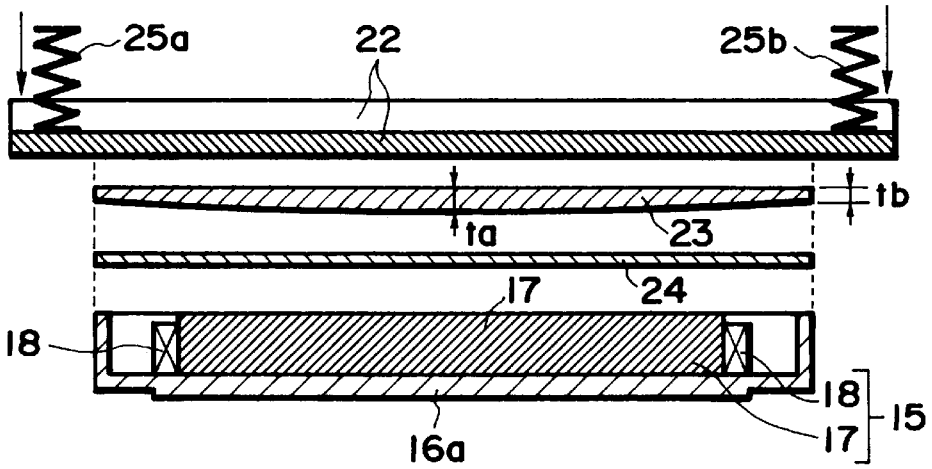
FIG. 9 is a longitudinal section of the image heating apparatus in another embodiment of the present invention.

Therefore, in the second embodiment of the present invention, which is depicted by the exploded section in FIG. 9, the thickness of the magnetism shielding plate 23, which is an intermediary member disposed between the stay 22 and the fixing nip N, is made greater toward the central portion than the end portion (thickness $t_a$ at the center is greater than thickness $t_b$ at the longitudinal ends), so that pressure is evenly applied across the length of the fixing nip N. Except for this modification, the structure of the fixing apparatus in the second embodiment is the same as that in the first embodiment.

More specifically, in order to obtain the same level of magnetism shielding effect as that obtained by the magnetism shielding plate 23 described in the first embodiment, so that the fixing apparatus is given the same level of improvement in the heat generating efficiency traceable to the effect of the magnetism shielding plate 23, or the like, the thickness $t_b$ of the thinnest portion, that is, each of the longitudinal ends, of the magnetism shielding plate 23 in this embodiment is set to 0.5 mm, and the thickness $t_a$ of the thickest portion, that is, the center portion is set to 1.5 mm, giving the top surface of the magnetism shielding plate 23 in this embodiment a crown-like surface curve of second degree.

As for the method for giving the top surface of the magnetism shielding plate 23 a crown-like curvature, there is a method in which a plate of uniform thickness may be simply bent or bent using a mold, in addition to the method described above. However, when the method other than varying the thickness is used to shape the magnetism shielding plate 23, the obtained crown-like shape of the plate 23 is liable to change with usage or elapse of time. In comparison, when the crown-like shape is given by varying the thickness as it is in this embodiment, the top surface of the plate 23 does not change its shape with elapse of time; it reliably keeps the crown-like shape even if pressure is applied for a long time. In other words, the structure in this embodiment is preferable in terms of superiority in durability.

The magnetism shielding plate 23 in this embodiment is so formed that the top of the crown-like contour thereof faces the insulative plate 24, but may be so formed that the top may face the stay 22, or the crown-like contour may be given to both surfaces, that is, the surface on the insulative plate side, and the surface on the stay side. In essence, the object of this shape change is to control the pressure distribution across the length of the fixing nip N by controlling the thickness of the magnetism shielding plate 23 across the length thereof, and the shape itself is not the main concern.

According to this second embodiment, not only can the effect described in the first embodiment be realized, but also a more desirable nip N can be formed, and the nip deformation which occurs with elapse of time can be minimized.

Figure 10:
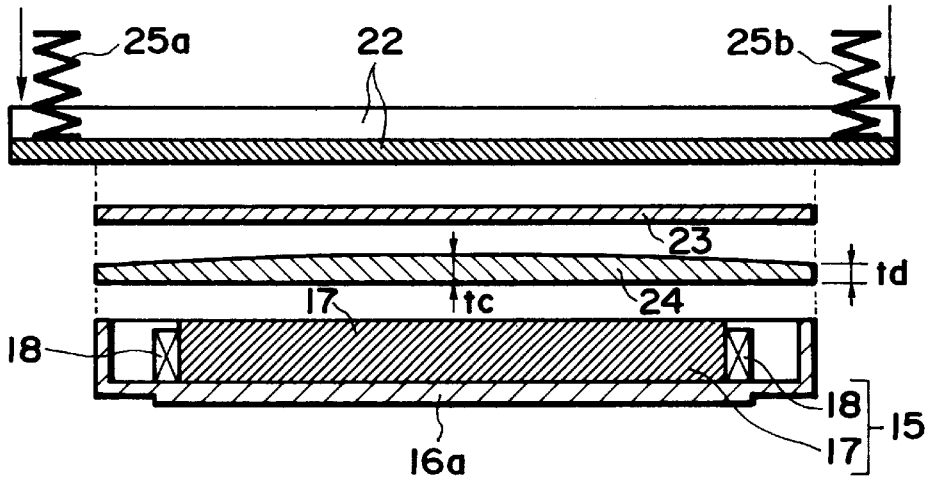
FIG. 10 is a longitudinal section of the image heating apparatus in another embodiment of the present invention.

FIG. 10 is an exploded sectional view of the essential section of the fixing apparatus in the third embodiment of the present invention. In this third embodiment, instead of controlling the thickness of the magnetism shielding plate 23, the thickness of the insulative plate 24 is controlled. More specifically, the thickness $t_c$ of the center portion is rendered greater than the thickness $t_d$ at each of both longitudinal ends, giving the crown-like contour to the top surface of the insulative plate 24, so that pressure is evenly generated in the fixing nip N across the length thereof. The other structural features of the fixing apparatus in this embodiment are the same as those described in the first embodiment.

In this embodiment, in order to keep the magnetism shielding plate 23 as effective as described in the first embodiment, the thickness $t_d$ of the thinnest portion, that is, each of both longitudinal ends, of the insulative plate 24 is set to 1 mm, and the thickness $t_c$ of the thickest portion, that is, the center portion, of the insulative plate 24 is set to 2 mm, given the top surface of the insulative plate 24 a crown-like curvature expressible by an equation of second degree.

As for the method for giving the top surface of the insulative plate 24 the crown-like curvature, there is a method in which a plate of uniform thickness is simply bent or bent using a mold, in addition to the method described above regarding the magnetism shielding plate 23. However, when the method other than varying the thickness is used to shape the insulative plate 24, the obtained crown-like shape of the plate 24 is liable to change with usage or elapse of time. In comparison, when the crown-like shape is given by varying the thickness as it is in this embodiment, the top surface of the plate 24 does not change its shape with elapse of time; it reliably keeps the crown-like shape even if pressure is applied for a long time. In other words, the structure in this embodiment is preferable in terms of superiority in durability.

The crown-like shape of the insulative plate 24 in this embodiment is on the magnetism shielding plate 23 side, but may be on the bottom film guide 16*a* side, that is, on the core 17 side, or the crown-like curvature may be given to both surfaces, that is, the surface on the magnetism shielding plate 23 side, and the surface on the bottom film guide 16*a* side, that is, the core 17 side. In essence, the object of this shape change is to control the pressure distribution across the length of the fixing nip N by controlling the thickness of the insulative plate 24 across the length thereof, and the shape of the insulative plate 24 itself is not the main concern.

According to this third embodiment, not only can the effect described in the second embodiment be realized, but also the fixing apparatus can be manufactured with smaller cost since the formation of the insulative plate 24 is easier than the formation of the magnetism shielding plate 23 composed of metallic material.

Figure 11:
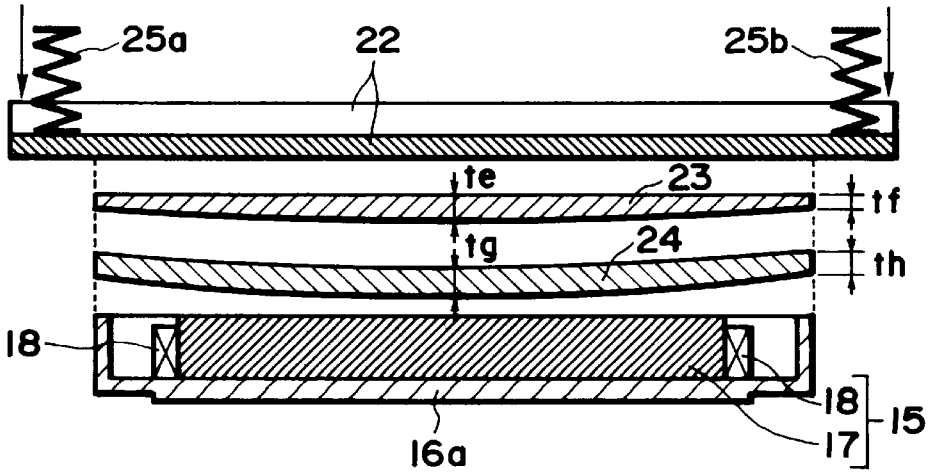
FIG. 11 is a longitudinal section of the image heating apparatus in another embodiment of the present invention.

FIG. 11 is an exploded schematic view of the essential portion of the fixing apparatus in the fourth embodiment of the present invention, in which both the magnetism shielding plate 23 and the insulative plate 24, which are the intermediary members, are modified. That is, their thickness is rendered thicker along the center portion than at each of both longitudinal ends, so that pressure is evenly generated in the fixing nip N across the length thereof. The other structural feature in the fixing apparatus in this embodiment are the same as those described in the first embodiment.

The center portion of the magnetism shielding plate 23 is rendered thicker than both longitudinal ends thereof, giving the magnetism shielding plate 23 a crown-like protrusion. More specifically, in order to make the magnetism shielding plate 23 in this embodiment as effective as the magnetism shielding plate 23 in the first embodiment, the thickness $t_f$ of the thinnest portion (both longitudinal ends) of the magnetism shielding plate 23 in this embodiment is made to be 0.5 mm, and the thickness $t_e$ of the thickest portion, that is, the center portion, is made to be 1 mm, giving the magnetism shielding plate 23 a crown-like protrusion which rises from the both longitudinal ends toward the center portion following a curve of second degree.

The thickness $t_h$ of the thinnest portion (both longitudinal ends) of the insulative plate 24 is made to be 1.0 mm, and the thickness $t_g$ of the thickest portion, that is, the center portion, is made to be 1.5 mm, giving also the insulative plate 24 a crown-like protrusion which rises from both longitudinal ends toward the center portion following a curve of second degree. The surface curves of the magnetism shielding plate 23 and the insulative plate 24, on the side where the plates 23 and 24 make contact are substantially the same, both being a curve of second degree.

Thus, in this embodiment, the crown-like protrusion of the pressure bearing surface, by which pressure is evenly generated in the fixing nip N across the entire length thereof, is effected by the combined thickness of the magnetism shielding plate 23 and the insulative plate 24.

According to this embodiment, a fixing nip as desirable as those described in the second and third embodiments can be formed, and the nip deformation which occurs with elapse of time can be minimized as effectively as described in the preceding two embodiments.

In the preceding embodiments, the pressure roller 30 as the second assembly was solidly disposed, and on top of it, the heating assembly as the first assembly is placed, wherein the latter is pressed upon the former by the pressing springs 25*a* and 25*b* as the members for pressing the heating assembly, and the stay as the pressure bearing member. However, the structure may be such that the stay 22, instead of the pressure roller 30, is solidly fixed, and the pressure roller 30 is pressed toward the stay 22 with the use of a pressing member to form the nip N, or such that both the heating assembly and the pressure roller 30 are pressed toward each other with the use of a pressing member to form the nip N.

In the preceding embodiments, an image forming apparatus was described as a color image forming apparatus based on four primary colors, but it may be a monochromatic image forming apparatus, a single pass multicolor image forming apparatus, or the like. In the case of the monochromatic or single pass apparatus, the elastic layer 2 may be eliminated from the fixing film 10 which generates heat by electromagnetic induction, and the heat generating layer 1 may be composed of mixture of resin and metallic filler.

Further, the fixing film 10 which generates heat by electromagnetic induction may have a two-layer structure comprising the heat generating layer 1 and the nonstick layer 3, or a three-layer structure comprising the thermally insulative layer 4, the heat generating layer 1, and the nonstick layer 3, or a single-layer structure comprising only the heat generating layer 1; the laminar structure of the fixing film 10 is optional.

The image formation principle and system of the image forming apparatus do not need to be limited to an electrophotographic process. In other words, this is optional; for example, it may be an electrostatic recording process of a transfer type or a direct type, a magnetic recording process, or the like.

It is unnecessary to limit the structure of the fixing apparatus 100 as a heating apparatus to a system described in the preceding embodiments, in which a pressure roller is driven.

Figure 12:
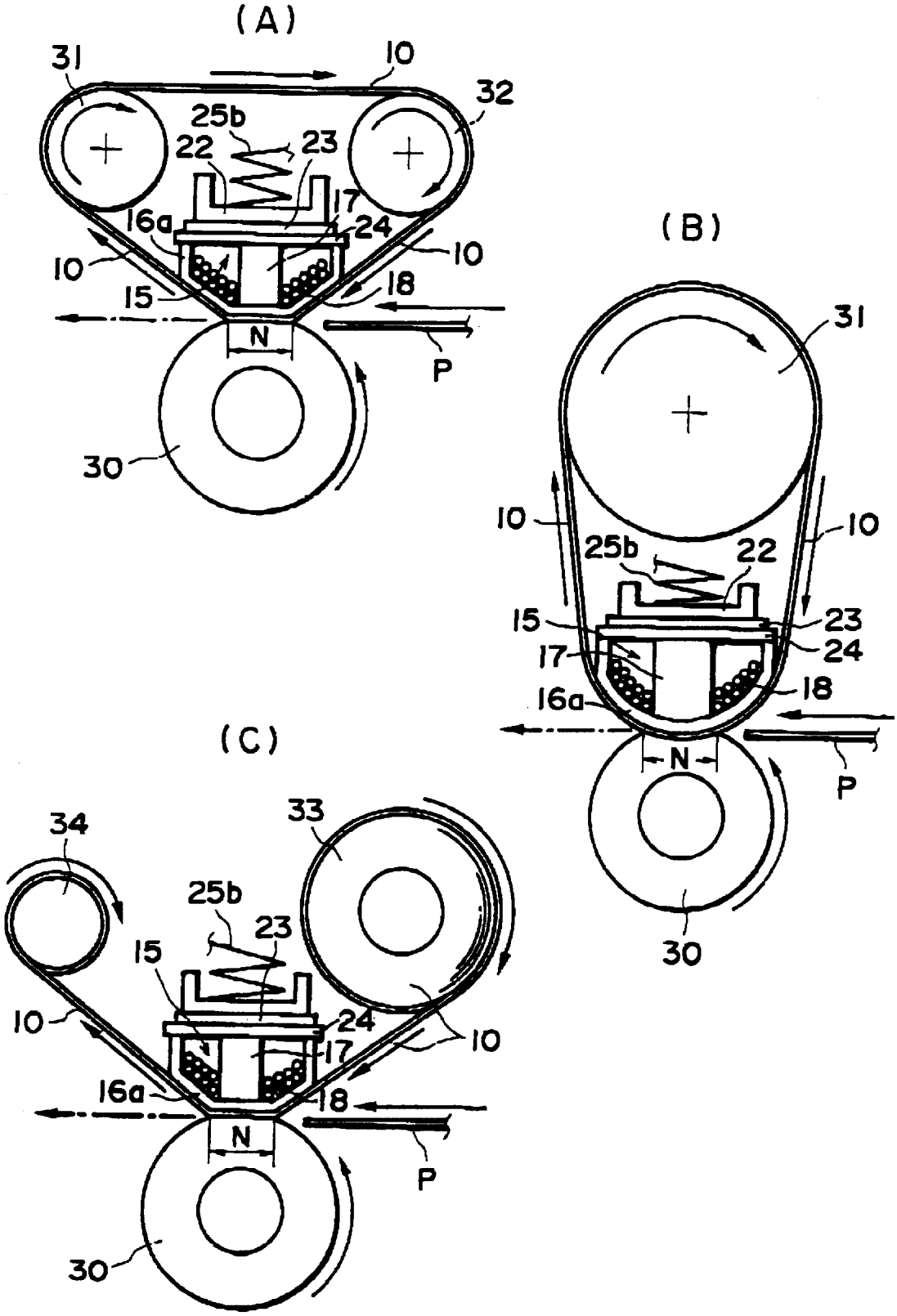
FIGS. 12, (*a, b* and *c*), are sections of an image heating apparatus to which the present invention is applicable.

For example it may be such a system, depicted in FIG. 12, (A), that an endless belt of the fixing film 10 which generates heat by electromagnetic induction is stretched around the film guide 16*a* of the heating assembly, as the first assembly, comprising the film guide 16*a*, core 17, exciter coil 18, stay 22 as a pressure bearing member, magnetism shielding plate 23, insulative plate 24, and the like, a driving roller 31, and a tension roller 32; the downwardly facing surface of the film guide 16*a* of the heating assembly and the upwardly facing surface of the pressure roller 30 as the second assembly are pressed against each other to form the fixing nip N with the fixing film 10 interposed between the two surfaces; and the fixing film 10 is rotatively driven by the driving roller 31. In this case, the pressure roller 30 is a follower roller.

In the case of the apparatus illustrated in FIG. 12, (B), an endless belt of the fixing film 10 which generates heat by electromagnetic induction is stretched around the film guide 16*a* of the heating assembly, and the driving roller 31, wherein the downwardly facing surface of the film guide 16*a* of the heating assembly and the upwardly facing surface of the pressure roller 31 as a pressing member are pressed against each other to form the fixing nip N with the fixing film 10 interposed between the two surfaces, and the fixing film 10 is rotatively driven by the driving roller 31.

In the case of the apparatus illustrated in FIG. 12, (C), a long roll of the fixing film 10 which generates heat by electromagnetic induction is mounted on the feeder axle. The leader portion of the fixing film 10 is pulled around the downwardly facing surface of the film guide 16*a* of the heating assembly, and attached to a take-up axle 34, and the downwardly facing surface of the film guide 16*a* and the upwardly facing surface of the pressure roller 30 are pressed against each other to form the fixing nip N with the fixing film interposed between the two surfaces, wherein the fixing film 10 is run from the feeder axle side to the take-up axle side at a predetermined speed.

Figure 13:
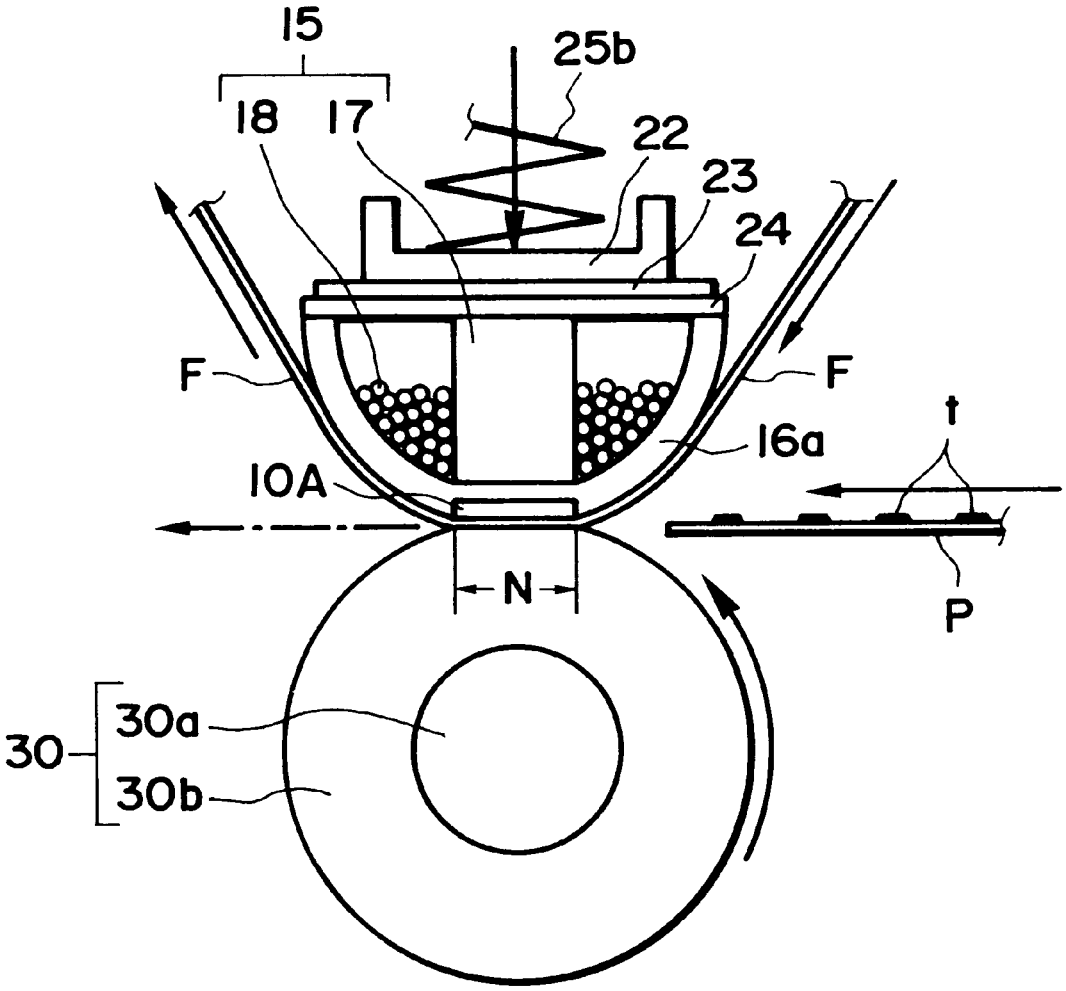
FIG. 13 is a section of an image heating apparatus to which the present invention is applicable.

The member which generates heat by electromagnetic induction may be a stationary member. FIG. 13 illustrates such a member.

In the drawing, an alphanumeric reference 10A designates an oblong flat member (iron plate or the like) which generates heat by electromagnetic induction. It is solidly fixed to the downwardly facing surface of the film guide 16*a* of the heating assembly. The fixing nip N is formed by pinching a heat resistant thin film F between the solidly mounted electromagnetic induction based heat generating member 10A and the pressure roller 30 as a second assembly. The bottom portion of the core 17 of the heating assembly faces the direction of the fixing nip N, in other words, the direction of the electromagnetic induction based heat generating member 10A.

The heat resistant film F may be in the form of an endless belt which is rotatively driven through the fixing nip N by a pressure roller or a dedicated driver roller, with the inwardly facing surface of the film F sliding on the downwardly facing surface of the solidly mounted electromagnetic induction based heating member 10A, or it may be in the form of a long roll which is fed from one side and taken up on the other side, with the film F sliding on the heating member 10A. The solidly mounted electromagnetic induction based heat generating member 10A generates heat as it is exposed to the concentration of the alternating magnetic flux which is generated by flowing alternating current through the exciter coil 18 of the heating assembly. The recording material P is introduced into the fixing nip N, being pinched between the heat resistant film F and the pressure roll, and passed through the fixing nip N together with the heat resistant film F. While the recording material P is passed through the fixing nip N, the toner image t on the recording material P receives the thermal energy outputted by the solidly mounted electromagnetic induction based heat generating member 10A through the heat resistant film F, and is fixed by the heat.

As for another method for solidly attaching the electromagnetic induction based heat generating member 10A to the film guide 16*a* in such a manner that the heat generating member 10A is disposed immediately below the exciter coil 18, the heat generating member 10A may be molded, together with the coil 18, into the film guide 16*a* when the film guide 16*a* is molded; the coil 18 and the heat generating member 10A may be integrally supported in the film guide mold when the film guide 16*a* is molded.

The pressing member 30 does not need to be in the form of a roller; it may be in another form, for example, a rotary belt.

In order to apply thermal energy to the recording material from the pressure roller 30 side as well as from the fixing film side, the pressure roller side may be equipped with heating means comprising an electromagnetic induction heater or a halogen heater to maintain the temperature on the pressure roller side at a predetermined level.

The usage of the heating apparatus in accordance with the present invention is not limited to the usage as an image heating apparatus described in the preceding embodiments; the heating apparatus in accordance with the present invention can be used as various types of means or apparatuses for heating an object. For example, it can be used as an image heating apparatus for heating the recording material bearing an image, to improve the surface properties such as glossiness, an image heating apparatus for temporarily fixing an image, an image heating apparatus for drying an object, or an image heating apparatus for thermally laminating an object.

While the invention has been described with reference to the structures disclosed herein, it is not confined to the details set forth, and this application is intended to cover such modifications or changes as may come within the purposes of the improvements or the scope of the following claims.

What is claimed is:

1. An image heating apparatus comprising:

a heat generating element having an electroconductive portion;

magnetic flux generating means for generating a magnetic flux, wherein said heat generating element generates heat by eddy current generated therein by the magnetic flux generated by said magnetic flux generating means;

a back-up member cooperating with said heat generating element to form a nip therebetween, wherein the recording material carrying an image is nipped and fed by said nip so that the image is heated;

a pressing member for applying pressure to said nip;

a metallic holding member for holding the pressure applied by said pressing member; and a shield member, provided between said magnetic flux generating means and said holding member, for shielding magnetic flux.

2. An apparatus according to claim 1, wherein said shield member is a non-magnetic electroconductive member.

3. An apparatus according to claim 2, wherein said shield member is of Al, Cu, Ag, Au or an alloy comprising at least one of Al, Cu, Ag, Au.

4. An apparatus according to claim 2, wherein said shield member has a volume resistivity of $3\times10^{-8}$ ohm.m or lower.

5. An apparatus according to claim 1, wherein a width, measured in a movement direction of the recording material, of said shield member is larger than that of said holding member.

6. An apparatus according to claim 1, wherein said magnetic flux generating means includes an excitation coil and a core.

7. An apparatus according to claim 6, wherein said shield member has a width, measured in a direction perpendicular to a movement direction of the recording material, which is larger than that of said excitation coil.

8. An apparatus according to claim 6, wherein said core is in the form of a rectangular parallelopiped elongated from a neighborhood of said nip in the pressing direction of said pressing member.

9. An apparatus according to claim 1, wherein said holding member is elongated in a direction perpendicular to a movement direction of the recording material, and said pressing member applies pressure to longitudinal end portions of said holding member.

10. An apparatus according to claim 9, wherein said shield member is elongated along said holding member, and has a width, measured in the pressing direction, reducing from longitudinally central portion toward the end portions of the shield member.

11. An apparatus according to claim 9, further comprising an electrically insulative member elongated along a holding member between said magnetic flux generating means and said shield member, said insulative member having a width, measured in the pressing direction, reducing from longitudinally central portion toward the end portions of the shield member.

12. An apparatus according to claim 1, wherein said holding member is composed of magnetic material.

13. An apparatus according to claim 12, wherein said holding member is composed of one of stainless steel and iron.

14. An apparatus according to claim 1, further comprising an electrically insulative member provided between said magnetic flux generating means and said shield member, and a guiding member for guiding movement of said heat generating element while supporting said magnetic flux generating means, wherein said insulative member is provided on said guiding member, and said shield member is provided on said insulative member, and said holding member is provided on said shield member.

15. An apparatus according to claim 14, wherein said pressing member applies pressure to back-up member through said holding member, said shield member, said insulative member, said guiding member and said heat generating element.

16. An apparatus according to claim 1, wherein said heat generating element is in the form of an endless film.

17. An apparatus according to claim 16, wherein said magnetic flux generating means, said holding member and said shield member, are inside said film.

18. An apparatus according to claim 1, wherein said heat generating element is fixed, and a film is provided between said heat generating element and said back-up member.

19. An apparatus according to claim 1, wherein said back-up member is in the form of a driving roller for driving said heat generating element.

20. An apparatus according to claim 1, wherein said shield member has a thickness of 0.5 mm or larger.

21. An apparatus according to claim 1, wherein a distance between said shield member and said magnetic flux generating means is 1 mm or larger.

22. An apparatus according to claim 21, wherein an electrically insulative member is provided between said shield member and said magnetic flux generating means, and a distance between said shield member and said magnetic flux generating means is substantially the same as a thickness of said insulative member.

23. An image heating apparatus comprising:

a heat generating element having an electroconductive portion;

magnetic flux generating means for generating a magnetic flux, wherein said heat generating element generates heat by eddy current generated therein by the magnetic flux generated by said magnetic flux generating means;

a back-up member cooperating with said heat generating element to form a nip therebetween;

wherein a recording material carrying an image is nipped and fed by said nip so that the image is heated;

a pressing member for applying pressure to said nip;

a holding member for holding the pressure applied by said pressing member, wherein said holding member is elongated in a direction perpendicular to the movement direction of the recording material, and said pressing member is provided at each longitudinal end of said holding member; and an intermediate member provided between said holding member and said nip and outside a portion where said magnetic flux generating means is closely opposed to said heat generating element, wherein said intermediate member has a crown configuration with respect to the longitudinal direction of said holding member.

24. An apparatus according to claim 23, wherein said intermediate member is convexed toward said holding member side.

25. An apparatus according to claim 23, wherein said intermediate member is convex toward said nip side.

26. An apparatus according to claim 23, wherein said intermediate member has a width, measured in a pressing direction of said pressing member, which reduces from a central portion to an end, with respect to a longitudinal direction of said holding member.

27. An apparatus according to claim 23, wherein said intermediate member includes an electrically insulative member provided between said holding member and said magnetic flux generating means.

28. An apparatus according to claim 23, wherein said magnetic flux generating means has an excitation coil and a core elongated along said holding member, and said pressing member urges said core through said holding member and said intermediate member.

29. An apparatus according to claim 23, further comprising a guiding member for guiding movement of said heat generating element while supporting said magnetic flux generating means, and said pressing member urges said back-up member through said holding member, said intermediate member, said magnetic flux generating means, said guiding member and said heat generating element.

30. An apparatus according to claim 23, wherein said holding member is metallic.

31. An apparatus according to claim 23, wherein said pressing member is a spring.

32. An apparatus according to claim 23, wherein said heat generating element is in the form of an endless film.

33. An apparatus according to claim 32, wherein said holding member, said intermediate member and said magnetic flux generating means are inside said film.

34. An apparatus according to claim 23, wherein said heat generating element is fixed, and a film is provided between said heat generating element and said back-up member.

35. An apparatus according to claim 23, wherein said back-up member is in the form of a driving roller for driving said heat generating element.

36. An apparatus according to claim 23, wherein said intermediate member is of metal.

37. An apparatus according to claim 23, wherein said intermediate member blocks the magnetic flux.

38. An apparatus according to claim 23, wherein said magnetic flux generating means includes an excitation coil and a core member.

39. An image heating apparatus comprising:

a heat generating element having an electroconductive portion;

magnetic flux generating means for generating a magnetic flux, wherein said heat generating element generates heat by eddy current generated therein by the magnetic flux generated by said magnetic flux generating means;

a back-up member cooperating with said heat generating element to form a nip therebetween, wherein a recording material carrying an image is nipped and fed by said nip so that the image is heated;

a pressing member for applying pressure to said nip, said pressing member being disposed at each end of said nip in a direction perpendicular to a movement direction of the recording material;

a holding member for holding the pressure applied by said pressing member; and an intermediate member provided between said holding member and said nip and outside a portion where said magnetic flux generating means is closely opposed to said heat generating element, wherein said intermediate member has a crown configuration with respect to the longitudinal direction of said holding member.

* * * * *

UNITED STATES PATENT AND TRADEMARK OFFICE

CERTIFICATE OF CORRECTION

PATENT NO. : 6,049,691

DATED : April 11, 2000

INVENTOR(S): ATSUYOSHI ABE, ET AL.

It is certified that error appears in the above-identified patent and that said Letters Patent is hereby corrected as shown below:

COVER PAGE AT ITEM [57] ABSTRACT:
Line 13, "shielding magnetic." should read --magnetic shielding.--.
COLUMN 4:
Line 42, "roll" should read --roller--.
COLUMN 10,
Line 46, "textural uneven" should read --uneven texture--.
COLUMN 11:
Line 4, "$6 \times 10^{-4 \leq \lambda \leq 2 \times 10^{-3}}$" should read --$6 \times 10^{-4} \leq \lambda \leq 2 \times 10^{-3}$.
COLUMN 13:
Line 14, "given" should read --giving--.

Signed and Sealed this

Third Day of April, 2001

*Attest:*

NICHOLAS P. GODICI

*Attesting Officer*

*Acting Director of the United States Patent and Trademark Office*